United States Patent [19]

MacDonald

[11] 3,995,221

[45] Nov. 30, 1976

[54] FLAME RESPONSIVE SYSTEM

[75] Inventor: Malcolm F. MacDonald, Chelmsford, Mass.

[73] Assignee: Electronics Corporation of America, Cambridge, Mass.

[22] Filed: Apr. 3, 1975

[21] Appl. No.: 564,801

Related U.S. Application Data

[63] Continuation-in-part of Ser. No. 560,569, March 20, 1975.

[52] U.S. Cl. ..... 328/6; 307/308; 328/1; 340/227 R; 340/228.2

[51] Int. Cl.[2] ..... H01V 3/26; G01N 27/00

[58] Field of Search ..... 328/1, 6; 340/227 R, 340/228.1, 228.2; 307/310, 308, 235 K

[56] References Cited

UNITED STATES PATENTS 2,722,677 11/1955 Krueger ..... 340/228.2

3,665,440 5/1972 McMenamin ..... 340/228.2

*Primary Examiner*—Stanley D. Miller, Jr.
*Assistant Examiner*—B. P. Davis

[57] ABSTRACT

A flame responsive system includes a flame sensor, flame signal generating circuitry responsive to the flame sensor and flame signal inhibiting circuitry also responsive to the flame sensor. A fast filter and a slower filter are coordinated so that total loss of flame sensor response results in rapid termination of a flame signal output from the flame signal generating circuitry while reduction of a flame sensor response below a set point causes the flame signal inhibiting circuitry to inhibit the flame signal output.

29 Claims, 6 Drawing Figures

FLAME RESPONSIVE SYSTEM

This application is a continuation in part of my copending application Ser. No. 560,569, filed Mar. 20, 1975, entitled "Flame Monitoring System".

SUMMARY OF INVENTION

This invention relates to flame responsive systems and more particularly to systems particularly adapted for monitoring flames in multi-burner furnaces, such as boilers for large electrical power generating stations.

Condition monitoring problems arise when the condition being monitored exists in a background environment of similar signals and the condition being monitored is to be discriminated by identification of frequency and amplitude variations which are in a continual state of flux. It has been found useful to apply low frequency filtration techniques to eliminate second-order modulation components from the detected condition signal. As the precision of comparison between the integrated condition signal and the threshold setpoint increases, however, there is increased delay in making the decision.

The desirability of monitoring the flame in a burner system has long been recognized. When fuel continues to be supplied to a burner after the flame has been extinguished, a potentially extremely hazardous condition is created as the flame may re-ignite explosively, and there is demand for improved flame monitoring systems that provide prompt and reliable indication of flame failure. In a system for monitoring the presence of a particular flame in a multi-burner system, the sensed consolidated furnace environment includes background signals from sources such as other flames within the combustion chamber, and ambiguous responses are generated if a fast response is utilized, while more precise discrimination between flame and background conditions is possible with increased response time. The detected signal from a flame is in a continuous state of change and the nature of the resulting signal is a function of the band width of the post-detection filter. A system having a fast flame failure response with a wide band post-detection filter will contain large peak-to-peak excursions in the signal. Signal-to-noise characteristics of such signals can be improved by decreasing post-detection filter band width.

It is an object of this invention to provide a novel and improved flame responsive system that provides differentiated response to a range of flame conditions that may exist in the monitored combustion environment. Another object of the invention is to provide a novel and improved flame monitoring system that is useful with systems in which flame failure response time requirement is relatively short, e.g. one second or less. Such systems frequently include a flame failure simulation mechanism such as a shutter for periodically checking the proper operation of the monitoring system. In such a system, the shutter closure interval typically is a small fraction of the flame failure response time of the system and the circuit response to shutter closure should be a fraction of the shutter closure interval. Accordingly, the circuit must respond rapidly to a large flame signal differential produced by the shutter closure (a simulated no flame condition), and must also respond to a flame failure condition where there is a smaller signal differential, due for example to extraneous background signals.

In accordance with an aspect of the invention, a flame responsive system is provided that has a fast flame failure response to a large change in flame signal and a slower response to a smaller change in flame signal so that improved discrimination capability is provided.

The invention provides a system which responds rapidly to total decrease of the detected signal to a level below a set point and also produces a clear flame-out response even when the second-order (noise) modulation raises the detected signal above the set point. A resulting flame responsive system rapidly signals flame out when all flame in the monitored area is extinguished and also provides a clear flame-out signal when the particular monitored flame is extinguished in the presence of large amounts of radiation from neighboring flames.

In preferred embodiments of the invention there is provided a flame monitoring system that includes a flame sensor for producing an electrical output signal derived from the monitored flame environment, and enhancing circuitry for augmenting the monitored flame component of the electrical signal and concurrently suppressing the background component of the electrical signal. A first channel responsive to the enhanced output signal has a relatively rapid response time and produces an output signal indicative of the flame condition in the monitored flame environment, and a second channel that is also responsive to the enhanced output signal has a slower response time than the first channel. The second channel in response to a flame sensor output signal of reduced magnitude for a significant interval inhibits generation by the first channel of output signals indicating the presence of flame in the monitored flame environment. It may be advantageous to employ additional channels with correspondingly graduated response times in particular arrangements.

In a particular embodiment the flame scanner comprises a silicon diode photosensor mounted in tubular structure which serves to collimate the scanner path. The scanner path intersects the axis of its burner system in the root portion of its flame which has a substantial higher frequency (i.e. above 100 Hz) component while portions of such flames more remote from the burner nozzle have a larger magnitude of lower frequency (i.e. below 100 Hz) components relative to the higher frequency components.

Flame signal enhancing circuitry is coupled to the flame sensor and produces an output that bears a direct relation to the higher frequency component (derived from the monitored flame) of the sensor signal and an inverse relation to the lower frequency component (derived from the background environment) of the sensor signal. That network includes a radiation source that has a high frequency response characteristic and a feedback circuit that includes an impedance element optically coupled to the radiation source whose impedance changes as a function of radiation incident thereon at a rate that is much slower than the speed of response of the radiation source. The feedback circuit moderates the output signal in proportion to the reciprocal of a fractional power of the low frequency component of the sensed radiation. Selective attenuation circuitry is coupled to the flame signal enhancing circuitry and has a low frequency cutoff that excludes all signals in the range of the second characteristic, a typical low frequency cutoff being about 200 Hertz. Gain adjustment means is provided for varying the magnitude of the enhanced flame signal.

The first channel includes a fast filter (short time constant integrator) network, a first comparator circuit and a one shot circuit responsive to the comparator for producing periodic output pulses in response to signals from the fast filter network. The second channel includes a slow filter (longer time constant integrator) network that has a much slower response time than the fast filter network and a second comparator circuit arranged to produce an output in response to a change in output of the slow filter network that is coupled to clamp the fast filter network and inhibit generation of output pulses by the one shot circuit. Offset circuitry also responds to the output of the second channel to raise the reference threshold signal applied to the second comparator circuit so that production of output pulses by the first channel are inhibited until the input signal rises above the augmented reference threshold at which time the output clamp is released and the second channel threshold is returned to its lower value.

Other objects, features and advantages will be seen as the following description of a particular embodiment progresses, in conjunction with the drawings, in which.

DESCRIPTION OF PARTICULAR EMBODIMENT

Figure 1:
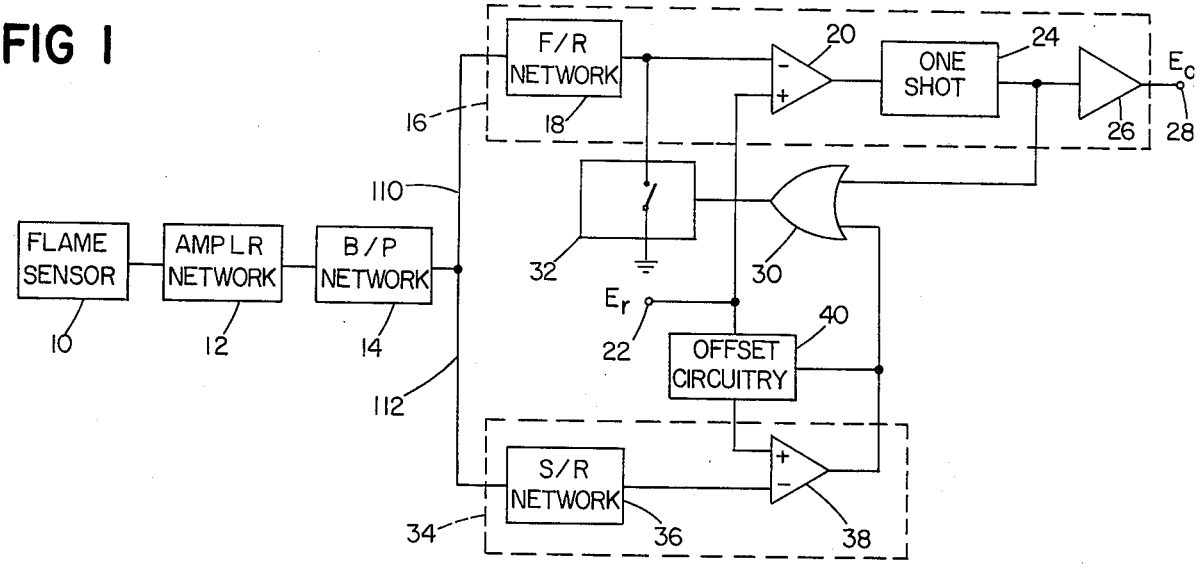
FIG. 1 is a block diagram of a flame monitoring system in accordance with the invention.

The flame monitoring system shown in FIG. 1 includes a flame sensor 10 that produces a flame signal output as a function of a sensed flame condition, which signal is processed by amplifier network 12 and band pass amplifier 14 and applied to output channel 16 to produce an output signal at terminal 28 that indicates the presence of flame in the monitored area. That output channel in this embodiment includes a high speed network 18 that has a time constant response of less than 100 milliseconds and its output is applied to comparator 20. A reference voltage ($E_r$) provided at terminal 22 is applied to the second or reference input of comparator 20. When network 18 produces an output that exceeds the reference voltage, comparator 20 produces an output which triggers one shot 24 to produce an output pulse that is applied by amplifier 26 to output terminal 28 as a flame present signal. The output pulse is also fed back through OR circuit 30 to operate switch 32 and clamp the response network 18 during the interval that an output pulse is generated by circuit 24. Upon termination of the output pulse, the clamp is released, permitting channel 16 to again respond to flame signals from network 14.

The AC signal from band pass circuit 14 is also applied to a second channel 34, the response of that channel being much slower than the response of channel 16 (a typical value being in the order of one to two seconds). That channel includes slow response network 36 and comparator 38. In normal operation comparator 38 has the reference voltage ($E_r$) applied to its reference terminal. When there is reduction in or absence of a flame signal from network 14 for a substantial interval of time so that the output of network 36 falls below the reference threshold ($E_r$), comparator 38 generates an output to inhibit the production of output signals at terminal 28. In this embodiment that output is applied through OR circuit 30 to operate switch 32 and clamp the network 18 in a fast response channel overriding action. The comparator output in this embodiment is also applied to offset circuit 40 to increase the reference voltage applied to comparator 38, thus raising the comparator threshold.

Figure 2A:
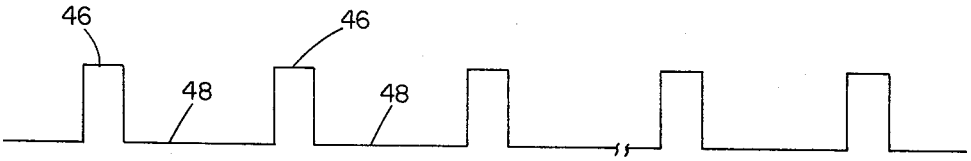
FIG. 2 is a timing diagram indicating aspects of the response of a flame monitoring system shown in FIG. 1.
Figure 2B:
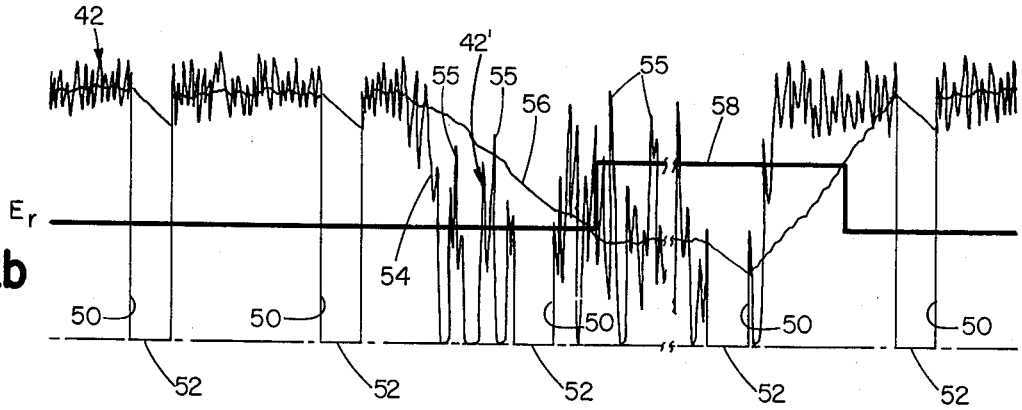
Figure 2D:
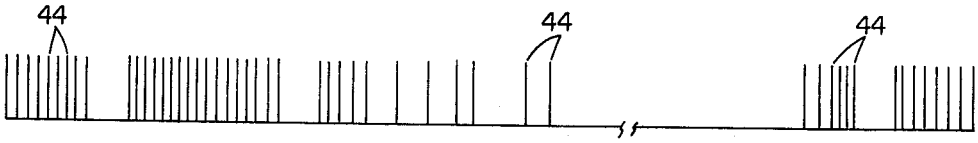
Figure 3:
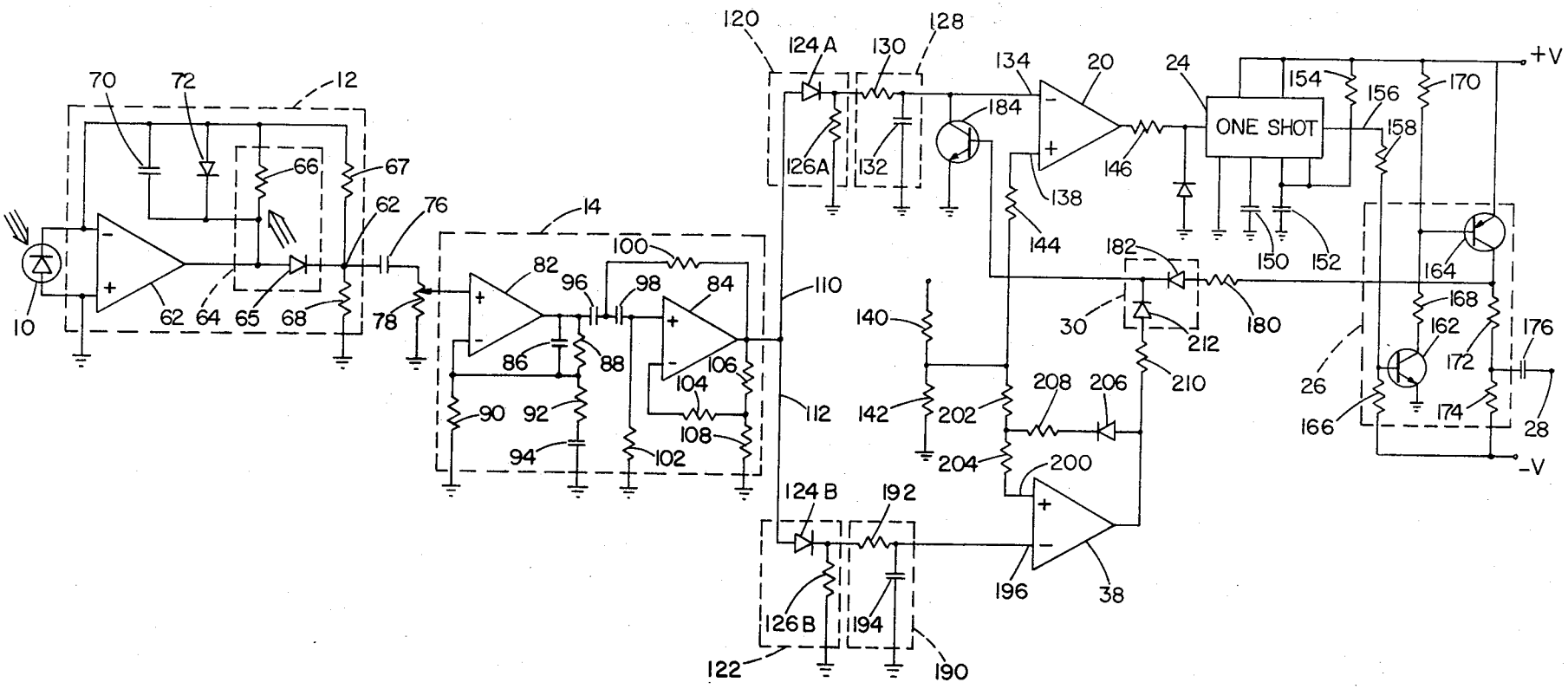
FIG. 3 is a schematic diagram of the flame monitoring system shown in FIG. 1.

With the supervised burner system in operation with supervision circuitry as shown in FIG. 3, sensor 10 produces an output which is processed through networks 12 and 14 to produce an AC signal 42 (shown in logarithmic plot in FIG. 2*b*) which is applied to the fast and slow response channels 16 and 34. The fast response network 18 of channel 16 generates an output as a function of the magnitude of the applied AC signal which output is applied to comparator 20. Each resulting comparator output triggers one shot 24 for production of a flame present pulse 44 (FIG. 2*d*) at terminal 28. Thus, in response to a flame signal the system normally produces a series of pulses 44 which are compatible with conventional burner control circuitry.

In certain systems, flame failure is periodically simulated, as with a shutter. The shutter sequence indicated at FIG. 2*a*, has a shutter closure interval 46 that is about one-fourth the duration of the shutter open interval 48. In a particular flame monitoring system with a flame failure response time of one second, for example, the shutter is open for about ¾ second and closed for about ¼ second in each cycle. Each shutter closure produces an abrupt decrease in flame signal 42 as indicated at line 50 in FIG. 2*b* (in about 0.1 second) and with a zero flame signal being produced by network 14 during the shutter closure interval as indicated diagrammatically at 52.

When flame failure at the monitored burner in a multi-burner system occurs, the magnitude of signal 42 drops rapidly as indicated at 54, but a residual signal 42' of considerate magnitude continues to exist due to background radiation from the furnace wall or another flame in the monitored environment, for example. While the residual signal level 42' as processed by the background gain control circuitry shown in FIG. 3 and disclosed in copending application Ser. No. 560,569, filed Mar. 20, 1975, entitled "Flame Monitoring System" and assigned to the same assignee as this application, is much lower than the normal flame signal level, signal spikes 55 are sufficiently frequent to periodically cause comparator 20 to trigger one shot 24 and produce output pulses 44 which, although at a lower repetition rate, are more frequent than the flame failure response time of the flame relay and thus the monitoring system continues to provide a flame detected response at terminal 28.

Figure 2C:
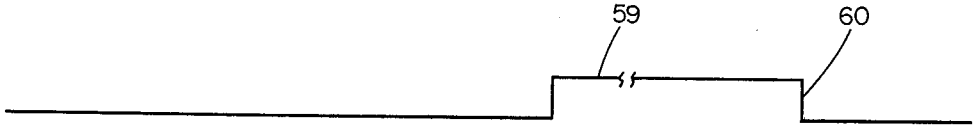

The output signal 56 (FIG. 2*b*) from network 36 in the slow response channel 34 decreases due to the reduced magnitude of the output signal 42'. If flame signal 42' of reduced magnitude continues to exist for an interval of time greater than the response time of channel 34, output 56 will be reduced below threshold $E_r$, producing an output 59 from comparator 38 as indicated in FIG. 2*c* which triggers offset circuit 40 to raise the reference threshold to level 58 as indicated in FIG. 2*b* and also applies a clamp to the fast response channel 16 preventing production of output pulses at terminal 28 as indicated at FIG. 2*d*. That clamp or inhibit condition remains until flame signal 42 is sufficiently strong due to re-establishment of flame at the monitored burner to cause network 36 to produce an output that exceeds the enhanced threshold 58 applied to the reference terminal of comparator 38 at which time the output of comparator 38 will switch as indicated at 60 in FIG. 2*c* and remove the clamp level from channel 16 as indicated in FIG. 2*c* permitting production of flame present pulses at terminal 28 to resume as an indication of the presence of flame by the monitored burner. Simultaneously the response threshold for the slow response channel 34 is dropped to the normal $E_r$ threshold (FIG. 2*b*).

Additional details of a particular embodiment may be seen with reference to FIG. 3. That circuit includes a flame sensor 10 connected across the input terminals of operational amplifier 62 in background gain control amplifier circuit 12. Sensor 10 is a silicon device that has a photosensitive junction region and is connected to operate in a photoconductive mode as a current source so that the sensed radiation intensity modifies the current flow as a function of the radiation incident on the sensor 10. Connected to the output of amplifier 62 is a photocoupler 64 that includes a silicon light emitting diode 65 optically coupled to a cadmium sulfide photoresistor 66. Photoresistor 66 and a supplemental resistor 67 are connected in the feedback path and diode 72 and capacitor 70 are connected across the photoresistor. This input amplifier stage 12 produces an output signal 42 (FIG. 2*b*) that is a direct function of the higher frequency components and an inverse function of the lower frequency components of the sensed radiation condition.

The transfer function for this circuit is of the form:

$$E_{O(AC)} = \frac{KI_{D(AC)}}{I_{D(DC)}{}^{n}}$$

where $I_{D(AC)}$ is the high frequency component of the current through sensor 10 and $I_{D(DC)}$ is the low frequency component of the current through sensor 10, and where *n* has been found to be in the range of 0.6–0.8.

That output signal is coupled by capacitor 76 to a gain control potentiometer 78. Potentiometer 78 provides gain adjustment for band pass filter 14 that includes operational amplifiers 82 and 84. The band pass filter components are selected to provide a center frequency of about 400 Hertz and a pass band of 400 Hertz. The resulting output signal is applied on lines 110 and 112 (as indicated in FIG. 1) to fast response channel 16 and slow response channel 34, respectively. Each channel includes a detector network 120, 122, and each network includes a diode 124 and a resistor 126.

The signal from detector network 120 is applied to high speed filter 128 that includes resistor 130 and capacitor 132 and has a time constant of about 50 milliseconds. The output of the filter 128 is applied to terminal 134 of operational amplifier 20 which is connected to function as a comparator. The voltage at reference terminal 138 of comparator 20 is supplied from a divider network which includes resistors 140 and 142 and is about 0.15 volt. When capacitor 132 is sufficiently charged so that the voltage at terminal 134 exceeds the voltage at terminal 138, amplifier 20 produces an output which triggers one shot circuit 24 and that circuit generates an output pulse of forty microsecond duration on output line 156. That output pulse is applied through resistor 158 to driver amplifier 26 that includes transistors 162 and 164 and the amplified output pulse is coupled by capacitor 176 to output terminal 28 as a flame present pulse. The amplified pulse is also coupled through resistor 180 and diode 182 or OR circuit 30 to switch clamp transistor 184 into conduction, thus discharging capacitor 132 and resetting the filter 128. The reset signal is removed at the end of the flame present pulse, permitting capacitor 132 to commence charging again toward the voltage that triggers one shot 24.

The slow response channel 34 includes filter 190 that includes resistor 192 and capacitor 194 and has a time constant of about 1 ½ seconds. The output of filter 190 is applied to input terminal 196 of comparator 38 whose reference terminal 200 is connected to the voltage divider network of resistors 140, 142 via resistors 202 and 204. A second connection to reference terminal 200 is from the hysteresis (offset) network 40 which is responsive to the output of comparator 38, and includes diode 206 and resistor 208. The comparator output is also applied via resistor 210 and diode 212 to the base of clamp transistor 184.

Should the output of filter 190 fall below 0.15 volt (the reference voltage at terminal 200), the output of comparator 38 switches positive and the output is applied through diode 206 to increase the reference voltage at terminal 200 to about 0.5 volt (thus raising the comparator threshold about 2 ½ times) and at the same time the output is applied through diode 212 of the OR circuit 30 to switch transistor 184 into conduction and clamp capacitor 132 in discharged condition thus preventing the production of flame present pulse signals at terminal 28 as long as comparator 38 is producing a positive output signal.

Thus, after a normal flame has been established, when output of filter 190 falls below the normal threshold of comparator 38, in response to decrease in the flame signal from the band pass amplifier 14 due for example to a low flame or no flame condition, comparator 38 switches its output signal, terminating the generation of flame present pulses at terminal 28 and also increasing the threshold of comparator 38. A larger flame signal (about 0.5 volt) is required to switch comparator 38 to remove the clamp from the input 134 of comparator 20 so that flame pulses will be again produced at output terminal 28 and when such flame signal is produced by filter 190, offset network 40 is switched back to the lower threshold value and the inhibited condition is removed.

Values and types of components employed in the embodiment shown in FIG. 3 are set out in the following table:

| Reference No. | Component Value or Type |
|---|---|
| 62 | N5556T |
| 64 | CLM8500 |
| 67 | 1M |
| 68 | 3.2K |
| 70 | 100pf |
| 76 | 0.01μf |
| 78 | 100K |
| 82 | N5558T |
| 84 | N5558T |
| 86 | 220pf |
| 88 | 1M |
| 90 | 1M |
| 92 | 3.3K |
| 94 | 0.47μf |
| 96 | 0.022μf |
| 98 | 0.022μf |
| 100 | 39K |
| 102 | 39K |

-continued

| Reference No. | Component Value or Type |
|---|---|
| 104 | 33K |
| 106 | 10K |
| 108 | 10K |
| 124A | 1N4448 |
| 124B | 1N4448 |
| 126A | 3.3K |
| 126B | 3.3K |
| 130 | 33K |
| 132 | 1.8μf |
| 140 | 10K |
| 142 | 100 |
| 144 | 33K |
| 146 | 4.7K |
| 150 | 0.01μf |
| 152 | 0.001μf |
| 154 | 33K |
| 158 | 10K |
| 162 | 2N2222 |
| 164 | 2N3073 |
| 166 | 100K |
| 168 | 1K |
| 170 | 10K |
| 172 | 100 |
| 174 | 220 |
| 176 | 0.47μf |
| 180 | 1K |
| 182 | 1N4448 |
| 184 | 2N2222 |
| 192 | 33K |
| 194 | 56μf |
| 202 | 3.3K |
| 204 | 33K |
| 206 | 1N4448 |
| 208 | 100K |
| 210 | 10K |

Thus, the invention provides a flame responsive system which rapidly responds to extinguishment of all flame in the monitored combustion chamber and also clearly responds to extinguishment of the particular flame it is monitoring, notwithstanding the detection of substantial radiation from neighboring flames.

While a particular embodiment of the invention has been shown and described, various modifications thereof will be apparent to those skilled in the art and therefore it is not intended that the invention be limited to the disclosed embodiment or to details thereof and departures may be made therefrom within the spirit and scope of the invention as defined in the claims.

What is claimed is:

1. A flame responsive system comprising a flame sensor that produces an electrical signal derived from the monitored flame environment, a first circuit responsive to the electrical signal from said flame sensor for producing an output signal indicative of the flame condition in the monitored flame environment, and a second circuit also responsive to the electrical signal from said flame sensor, said second circuit having a slower response time than that of said first circuit, said second circuit being arranged to produce in response to a change in said electrical signal that indicates a decrease in magnitude of flame in the monitored flame environment an output that inhibits generation by said first circuit of signals indicating the presence of flame in the monitored flame environment.

2. The system as claimed in claim 1 wherein said first circuit includes an integrator network, and threshold responsive circuitry responsive to said integrator network for producing a flame condition output signal, and said second circuit output is coupled to inhibit generation of said flame condition signal by said threshold responsive circuitry.

3. The system as claimed in claim 2 wherein said second circuit includes a second integrator network that has a much slower response time than said first integrator network and second threshold responsive circuitry responsive to said second integrator network for producing said second circuit output.

4. The system as claimed in claim 1 and further including offset circuitry responsive to said second circuit output for changing the reference threshold signal applied to said second circuit.

5. The system as claimed in claim 1 wherein said first circuit includes a fast response network, a first comparator circuit and a one shot circuit responsive to said comparator for producing periodic output pulses in response to signals from said fast response network, and said second circuit output is coupled to clamp said fast response network and inhibit generation of output pulses by said one shot circuit.

6. The system as claimed in claim 1 wherein said first circuit includes a fast response network and said second circuit includes a slow response network that has a much slower response time than said fast response network, a comparator circuit, means to apply a reference threshold signal to said comparator circuit, said comparator circuit being arranged to produce said second circuit output in response to a decrease in output of said slow response network below said reference threshold, and offset circuitry responsive to said second circuit output for increasing the reference threshold signal applied to said comparator circuit.

7. The system as claimed in claim 5 wherein said fast response network includes a first integrator network, and said fast circuit further includes first threshold responsive circuitry responsive to said first integrator network for producing a flame condition output signal, and said second circuit output is coupled to inhibit generation of said flame condition signal by said first threshold responsive circuitry.

8. The system as claimed in claim 7 wherein said second circuit includes a second integrator network that has a much slower response time than said first integrator network and second threshold responsive circuitry responsive to said second integrator network for producing said second circuit output.

9. The system as claimed in claim 8 wherein said flame sensor is a solid state device that has a photosensitive junction region.

10. The system as claimed in claim 1 and further including flame signal enhancing circuitry coupled to said flame sensor, said flame signal enhancing circuitry having a first response as a function of the monitored flame component of said electrical signal and a second response different from said first response as a function of the background component of said electrical signal and being arranged to provide an enhanced flame signal representative of the monitored flame as an output signal for application to said first and second circuits.

11. The system as claimed in claim 10 and further including selective attenuation circuitry coupled between said flame signal enhancing circuitry and said first and second circuits, said selective attenuation circuitry attenuating components of said output signal corresponding to the frequency range of said background component of said electrical signal.

12. The system as claimed in claim 11 wherein said selective attenuation circuitry has a low frequenty cutoff that excludes all signals in the range of said background component.

13. The system as claimed in claim 10 and further including gain adjustment means for varying the magnitude of said enhanced flame signal and detector circuitry coupled between said flame signal enhancing circuitry and said first and second circuits.

14. The system as claimed in claim 1 and further including flame failure simulation means for periodically simulating a flame failure condition and wherein the response time of said first circuit is a fraction of the duration of the flame failure condition simultated by said simulation means.

15. The system as claimed in claim 14 wherein said first circuit includes an integrator network, and threshold responsive circuitry responsive to said integrator network for producing a flame condition output signal, and said second circuit output is coupled to inhibit generation of said flame condition signal by said threshold responsive circuitry.

16. The system as claimed in claim 15 wherein said second circuit includes a second integrator network that has a much slower response time than said first integrator network and second threshold responsive circuitry responsive to said second integrator network for producing said second circuit output.

17. A flame responsive system comprising a solid state flame sensor device that has a photosensitive region and produces an electrical signal derived from the monitored flame environment, flame signal enhancing circuitry coupled to said flame sensor and including an amplifier and a feedback network arranged so that the influence of said monitored flame component is enhanced and the influence of said background component is attenuated, said flame signal enhancing circuitry being arranged to provide an enhanced flame signal representative of the monitored flame, a first circuit responsive to said enhanced flame signal for producing an output signal indicative of the flame condition in the monitored flame environment, said first circuit including a first integrator network and first threshold circuitry responsive to said first integrator network for producing said flame condition output signal, a second circuit also responsive to said enhanced flame signal, said second circuit including a second integrator network that has a much slower response time than said first integrator network and second threshold responsive circuitry responsive to said second integrator network for producing a second circuit output, said second circuit output being coupled to inhibit generation of said flame condition output signal by said first circuit when said enhanced flame signal falls below the reference threshold signal applied to said second threshold responsive circuitry.

18. The system as claimed in claim 17 wherein said feedback network includes an impedance element that has a damped response to said electrical signal.

19. The system as claimed in claim 18 wherein said enhancing circuitry includes a radiation source coupled to be energized by the output of said amplifier and said impedance element is a slow speed photoresistor that is optically coupled to said radiation source.

20. The system as claimed in claim 19 wherein said flame signal enhancing circuitry has a transfer function of the form $$E_{O(AC)} = \frac{KI_{D(AC)}}{I_{D(DC)}^{n}}$$

where $n$ is in the range of 0.6–0.8.

21. The system as claimed in claim 17 and further including offset circuitry responsive to said second circuit output for increasing the reference threshold signal applied to said second threshold responsive circuitry.

22. The system as claimed in claim 21 and further including flame failure simulation means for periodically simulating a flame failure condition and wherein the response time of said first circuit is a fraction of the duration of the flame failure condition simulated by said simulation means and the response time of said second circuit is greater than the duration of the flame failure condition simulated by said simulation means.

23. A flame responsive system comprising a flame sensor that produces an electrical signal derived from the monitored flame environment, flame failure simulation means for periodically simulating a flame failure condition, a first circuit responsive to the electrical signal from said flame sensor for producing an output signal indicative of the flame condition in the monitored flame environment, the response time of said first circuit being a fraction of the duration of the flame failure condition simulated by said simulation means, a second circuit also responsive to the electrical signal from said flame sensor, said second circuit having a response time slower than that of said first circuit and greater than the duration of the flame failure condition simulated by said simulation means, said second circuit arranged to produce an output that inhibits generation by said first circuit of signals indicating the presence of flame in the monitored flame environment, means for applyiing a reference threshold signal to said second circuit, and offset circuitry responsive to said second circuit output for changing the reference threshold signal applied to said second circuit.

24. The system as claimed in claim 23 and further including flame signal enhancing circuitry coupled to said flame sensor, said flame signal enhancing circuitry having a first response as a function of the monitored flame component of said electrical signal and a second response different from said first response as a function of the background component of said electrical signal and being arranged to provide an enhanced flame signal representative of the monitored flame as an output signal for application to said first and second circuits.

25. In a flame responsive system, a signal processor responsive to a flame sensor that produces an electrical signal derived from the monitored flame environment comprising flame signal generating circuitry, a first circuit responsive to said electrical signal for actuating said flame signal generating circuitry, flame signal inhibiting circuitry and a second circuit responsive to said electrical signal for actuating said flame signal inhibiting circuitry, said first circuit having a faster response time than said second circuit and said first and second circuits being associated so that total loss of flame sensor response results in rapid termination of flame signal output from said flame signal generating circuitry and reduction of flame sensor response to a level below a set point causes said flame signal inhibiting circuitry to inhibit said flame signal output.

26. The system as claimed in claim 25 wherein said signal generating circuitry includes a first comparator circuit and a one shot circuit responsive to said comparator for producing periodic output pulses in response to signals from said first circuit, and said signal inhibiting circuitry is coupled to clamp said first circuit and inhibit generation of output pulses by said one shot circuit.

27. The system as claimed in claim 26 wherein said signal inhibiting circuitry includes a second comparator circuit responsive to the output of said second circuit.

28. The system as claimed in claim 27 and further including offset circuitry responsive to said signal inhibiting circuitry output for changing the reference threshold signal applied to said second comparator.

29. The system as claimed in claim 28 and further including flame signal enhancing circuitry coupled to said flame sensor, said flame signal enhancing circuitry having a first response as a function of the monitored flame component of said sensor signal and a second response different from said first response as a function of the background component of said sensor signal and being arranged to provide an enhanced flame signal representative of the monitored flame as an output signal for application to said signal processor.

* * * * *